US008712768B2

(12) United States Patent
Laaksonen et al.

(10) Patent No.: US 8,712,768 B2
(45) Date of Patent: Apr. 29, 2014

(54) SYSTEM AND METHOD FOR ENHANCED ARTIFICIAL BANDWIDTH EXPANSION

(75) Inventors: Laura Laaksonen, Espoo (FI); Päivi Valve, Tampere (FI)

(73) Assignee: Nokia Corporation, Espoo (FI)

( * ) Notice: Subject to any disclaimer, the term of this patent is extended or adjusted under 35 U.S.C. 154(b) by 2064 days.

(21) Appl. No.: 10/853,820

(22) Filed: May 25, 2004

(65) Prior Publication Data

US 2005/0267741 A1 Dec. 1, 2005

(51) Int. Cl.
*G10L 21/02* (2013.01)

(52) U.S. Cl.
USPC ..... 704/226; 704/200.1; 704/201; 704/208; 704/209; 704/210

(58) Field of Classification Search
USPC ..... 704/209, 201, 200.1, 226, 225, 208, 704/210
See application file for complete search history.

(56) References Cited

U.S. PATENT DOCUMENTS

| | | | | |
|---|---|---|---|---|
| 5,596,676 | A * | 1/1997 | Swaminathan et al. | 704/208 |
| 6,418,412 | B1 * | 7/2002 | Asghar et al. | 704/256.5 |
| 6,681,202 | B1 * | 1/2004 | Miet et al. | 704/214 |
| 6,898,566 | B1 * | 5/2005 | Benyassine et al. | 704/226 |
| 7,181,402 | B2 * | 2/2007 | Jax et al. | 704/500 |
| 2001/0027390 | A1 * | 10/2001 | Rotola-Pukkila et al. | 704/219 |
| 2002/0128839 | A1 * | 9/2002 | Lindgren et al. | 704/258 |
| 2003/0050786 | A1 | 3/2003 | Jax et al. | |
| 2003/0093279 | A1 * | 5/2003 | Malah et al. | 704/265 |
| 2004/0002856 | A1 * | 1/2004 | Bhaskar et al. | 704/219 |
| 2004/0138876 | A1 | 7/2004 | Kallio et al. | |
| 2005/0004796 | A1 * | 1/2005 | Trump et al. | 704/225 |

FOREIGN PATENT DOCUMENTS

| | | |
|---|---|---|
| CN | 1416561 | 5/2003 |
| CN | 1496559 | 5/2004 |

OTHER PUBLICATIONS

J. Epps and W. H. Holmes, "A New Technique for Wideband Enhancement of Coded Narrowband Speech," School of Electrical Engineering and Telecommunications, The University of New South Wales, Sydney 2052 Australia, 1999, pp. 174-176, Australia.
Voice Activity Detection Over Multiresolution Subspaces, Nurgun Erdol and Robert Schultz, IEEE Copyright 2000, pp. 217-220.
Project Report Artificial Bandwidth Expansion of Telephone Speech with Special Emphasis on Processing of Fricatives, Laura Kallio, Helsinki University of Technology, Laboratory of Acoustics and Audio Signal Processing,Finland, Sep. 24, 2002, pp. 1-46.
Avendano, C., et al.; "Beyond Nyquist: Towards the recovery of broad-bandwidth speech from narrow-bandwidth speech"; Proceedings Eurospeech '95; Madrid, Spain; 1995; pp. 165-168.
Carl, H., et al.: "Bandwidth Enhancement of Narrow-Band Speech Signals"; Proceedings EUSIPCO '94, Edinburgh, 1994, pp. 1178-1181.

(Continued)

*Primary Examiner* — Qi Han
(74) *Attorney, Agent, or Firm* — Alston & Bird LLP

(57) ABSTRACT

A method, device, system, and computer program product expand narrowband speech signals to wideband speech signals. The method includes determining signal type information from a signal, obtaining characteristics for forming an upper band signal using the determined signal type information, determining signal noise information, using the determined signal noise information to modify the obtained characteristics for forming the upper band signal, and forming the upper band signal using the modified characteristics.

11 Claims, 5 Drawing Sheets

(56) References Cited

OTHER PUBLICATIONS

Chan, C-F., et al.; "Wideband re-synthesis of narrowband CELP-coded speech using multiband excitation model"; Proceedings International Conference on Spoken Language; 1996; pp. 322-325.
Cheng, Y.M., et al.; "Statistical recovery of wideband speech from narrowband speech", IEEE Transactions on Speech and Audio Processing; vol. 2; Issue 4; Oct. 1994; pp. 544-548.
Enbom, N., et al.; "Bandwidth expansion of speech based on vector quantization of the Mel frequency cepstral coefficients"; IEEE Workshop on Speech Coding Proceedings; Porvoo, Finland; 1999; pp. 171-173.
Epps, J., et al.; "A new technique for wideband enhancement of coded narrowband speech"; IEEE Workshop on Speech Coding Proceedings; Porvoo, Finland; 1999; pp. 174-176.
Jax, P., et al.; "Wideband extension of telephone speech using a hidden Markov model", IEEE Workshop on Speech Coding Proceedings; Delavan, Wisconsin, US; 2000; pp. 133-135.
Park, K.-Y., et al.; "Narrowband to wideband conversion of speech using GMM based transformation"; Proceedings of IEEE International Conference on Acoustics, Speech and Signal Processing; Istanbul, Turkey; Jun. 2000; pp. 1843-1846.
Yasukawa, H.; Quality enhancement of band limited speech by filtering and multirate techniques; Proceedings International Conference on Spoken Language; Yokohama, Japan; Sep. 1994; pp. 1607-1610.
Yasukawa, H.; "Enhancement of telephone speech quality by simple spectrum extrapolation method"; Proceedings Eurospeech'95; Madrid, Spain; 1995; pp. 1545-1548.
Yasukawa, H.; "Restoration of wide band signal from telephone speech using linear prediction error processing"; Proceedings International Conference on Spoken Language; 1996; pp. 901-904.
Yasukawa, H.; "Signal restoration of broad band speech using non-linear processing"; Proceedings of European Signal Processing Conference (EUSIPCO '96); Trieste, Italy; Sep. 1996; pp. 987-990.
Yoshida, Y., et al; "An algorithm to reconstruct wideband speech from narrowband speech based on codebook mapping", Proceedings International Conference on Spoken Language; Yokohama, Japan; Sep. 1994; pp. 1591-1594.
First Office Action for Chinese Patent Application No. 20050023428.7, issued Jun. 5, 2009.

* cited by examiner

SYSTEM AND METHOD FOR ENHANCED ARTIFICIAL BANDWIDTH EXPANSION

FIELD OF THE INVENTION

The present invention relates to systems and methods for quality improvement in an electrically reproduced speech signal. More particularly, the present invention relates to a system and method for enhanced artificial bandwidth expansion for signal quality improvement.

BACKGROUND OF THE INVENTION

Speech signals are usually transmitted with a limited bandwidth in telecommunication systems, such as a GSM (Global System for Mobile Communications) network. The traditional bandwidth for speech signals in such systems is less than 4 kHz (0.3-3.4 kHz) although speech contains frequency components up to 10 kHz. The limited bandwidth results in a poor performance in both quality and intelligibility. Humans perceive better quality and intelligibility if the frequency band of speech signal is wideband, i.e. up to 8 kHz.

Characteristics of noise can vary a lot. Noise can be, for example, quiet office noise, loud car noise, street noise or babble noise (babble of voices, tinkle of dishes, etc.). In addition to different characteristics, noise can be present either around the mobile phone user in the near-end (tx-noise) or around the other party of the conversation at the far-end (rx-noise). The rx-noise corrupts the speech signal and, therefore, the noise becomes also expanded to the high band together with speech. In situations with a high rx-noise level, this is a problem because the noise starts to sound annoying due to artificially generated high frequency components. Tx-noise degrades the intelligibility by masking the received speech signal.

Prior art artificial bandwidth expansion (ABE) solutions suffer from poor performance in noisy situations. One prior ABE solution is described in U.S. patent application Ser. No. 10/341,332 entitled "Method and Apparatus for Artificial Bandwidth Expansion in Speech Processing" assigned to the same assignee as the present application and incorporated herein by reference in its entirety. An advantage of this earlier developed ABE algorithm is that it is considerably more robust with noisy and coded speech. However, there are problems with this algorithm, including the presence of artifacts which degrade the overall naturalness of perceived quality. Sudden changes in the high band of expanded speech can cause audible artifacts. Further, this prior algorithm includes a frequency bandwidth of 0-4 kHz.

Missing frequency components are especially important for speech sounds like fricatives, (for example /s/ and /z/) because a considerable part of the frequency components are located above 4 kHz. The intelligibility of plosives (/t/, /p/ etc.) suffers from the lack of high frequencies as well, even though the main information of these sounds is in lower frequencies. For voiced sounds, the lack of frequencies results mainly in a degraded perceived naturalness. Because the importance of the high frequency components differs among the speech sounds, the generation of the high band of an expanded signal should be performed differently for each group of phonemes.

Thus, there is a need for a robust computational method for the classification of different phoneme groups. Further, there is a need for an improved method that prevents misclassifications and thereby audible artifacts still present in the previous algorithms. Even further, there is a need for an improved system and method for enhanced artificial bandwidth expansion for signal quality improvement.

SUMMARY OF THE INVENTION

The present invention is directed to a method, device, system, and computer program product for expanding the bandwidth of a speech signal by inserting frequency components that have not been transmitted with the signal. The system includes noise dependency to an artificial bandwidth expansion algorithm. This feature takes into account noise conditions and adjusts the algorithm automatically so that the intelligibility of speech becomes maximized while preserving good perceived quality.

Briefly, one exemplary embodiment relates to a method for expanding narrowband speech signals to wideband speech signals. The method includes determining signal type information from a signal, obtaining characteristics for forming an upper band signal using the determined signal type information, determining signal noise information, using the determined signal noise information to modify the obtained characteristics for forming the upper band signal, and forming the upper band signal using the modified characteristics.

Another exemplary embodiment relates to a terminal device configured to receive wideband signals. The device includes an interface that communicates with a wireless network and programmed instructions stored in a memory and configured to expand received narrowband signals to wideband signals by adjusting an artificial bandwidth expansion algorithm based on noise conditions.

Another exemplary embodiment relates to a network device or module in a communication network that expands narrowband speech signals into wideband speech signals. The device includes a narrowband codec that receives narrowband speech signals in a network, a wideband codec that communicates wideband speech signals to wideband terminals in communication with the network, and programmed instructions that expand the narrowband speech signals to wideband speech signals by adjusting an artificial bandwidth expansion algorithm based on noise conditions.

Yet another exemplary embodiment relates to a system for expanding narrowband speech signals to wideband speech signals. The system includes means for determining signal type information from a signal, means for obtaining characteristics for forming an upper band signal using the determined signal type information, means for determining signal noise information, means for using the determined signal noise information to modify the obtained characteristics for forming the upper band signal, and means for forming the upper band signal using the modified characteristics.

Yet another exemplary embodiment relates to a computer program product that expands narrowband speech signals to wideband speech signals. The computer program product includes computer code to determine signal type information from a signal, obtain characteristics for forming an upper band signal using the determined signal type information, determine signal noise information, use the determined signal noise information to modify the obtained characteristics for forming the upper band signal, and form the upper band signal using the modified characteristics.

Other principle features and advantages of the invention will become apparent to those skilled in the art upon review of the following drawings, the detailed description, and the appended claims.

BRIEF DESCRIPTION OF THE DRAWINGS

Exemplary embodiments will hereafter be described with reference to the accompanying drawings.

DETAILED DESCRIPTION OF EXEMPLARY EMBODIMENTS

Figure 1:
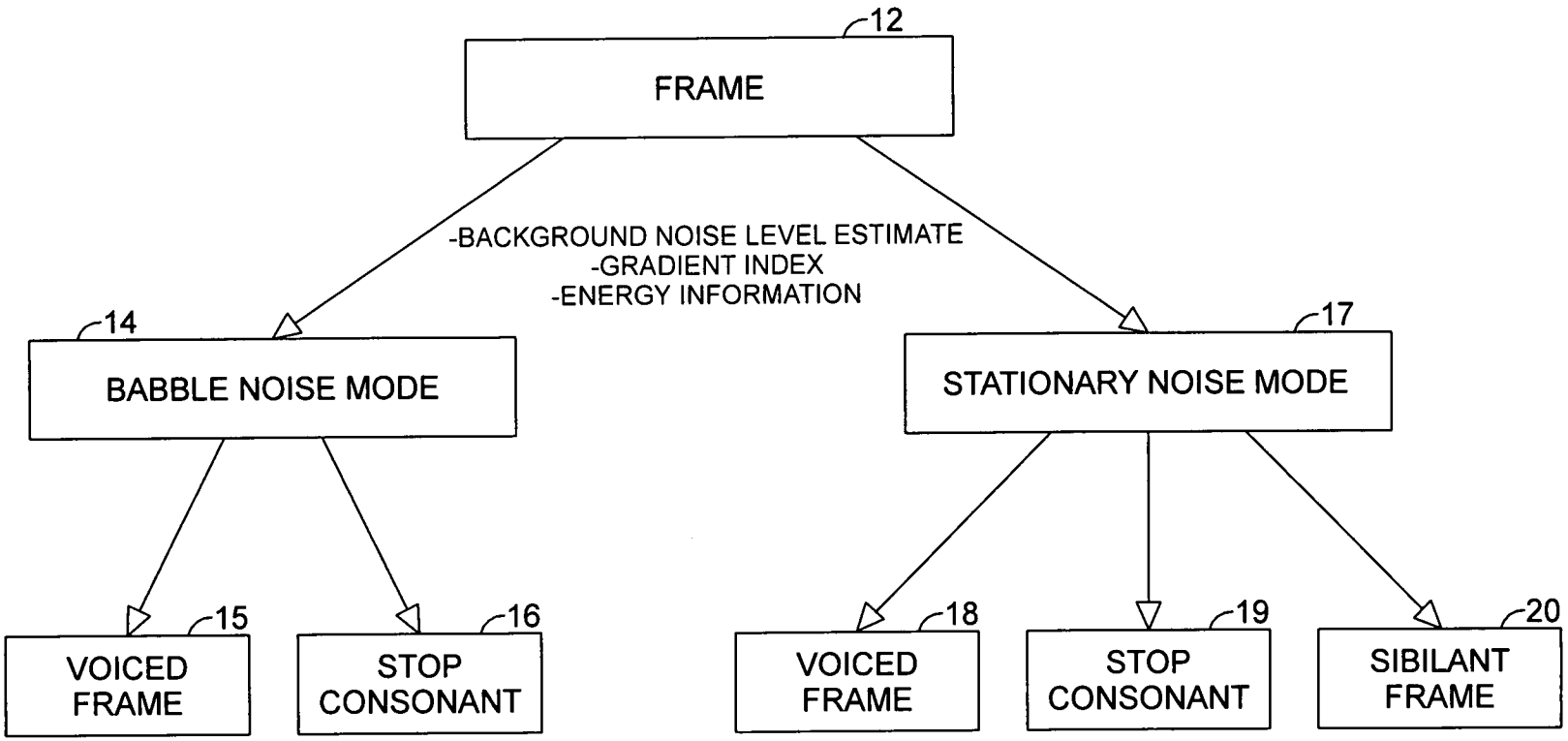
FIG. 1 is a diagram depicting the division of noise in accordance with an exemplary embodiment.

FIG. 1 illustrates an exemplary division of noise from a frame 12 of a communication signal into babble noise 14 and stationary noise 17 according to a frame classification algorithm. Babble noise 14 can be divided into voiced frames 15 and stop consonants 16. Stationary noise 17 can be divided into voiced frames 18, stop consonants 19, and sibilant frames 20. Babble noise detection is based on features that reflect the spectral distribution of frequency components and, thus, make a difference between low frequency noise and babble noise that has more high frequency components.

Accounting for noise conditions can improve speech intelligibility while preserving perceived quality. Noise dependency can be divided into rx-noise (far end) dependency and tx-noise (near end) dependency. The rx-noise dependency makes it possible to increase the audio quality by avoiding the creation of disturbing noise to the high band during babble noise and loud stationary noise. The audio quality is increased by adjusting the algorithm on the basis of the noise mode and rx-noise level estimate. The tx-noise dependency, on the other hand, makes it possible to tune the algorithm so, that the intelligibility can be maximized. In a loud tx-noise environment, the algorithm can be very aggressive because the noise masks possible artifacts. In a silent tx-noise environment, the audio quality is maximized by minimizing the amount of artifacts.

Figure 2:
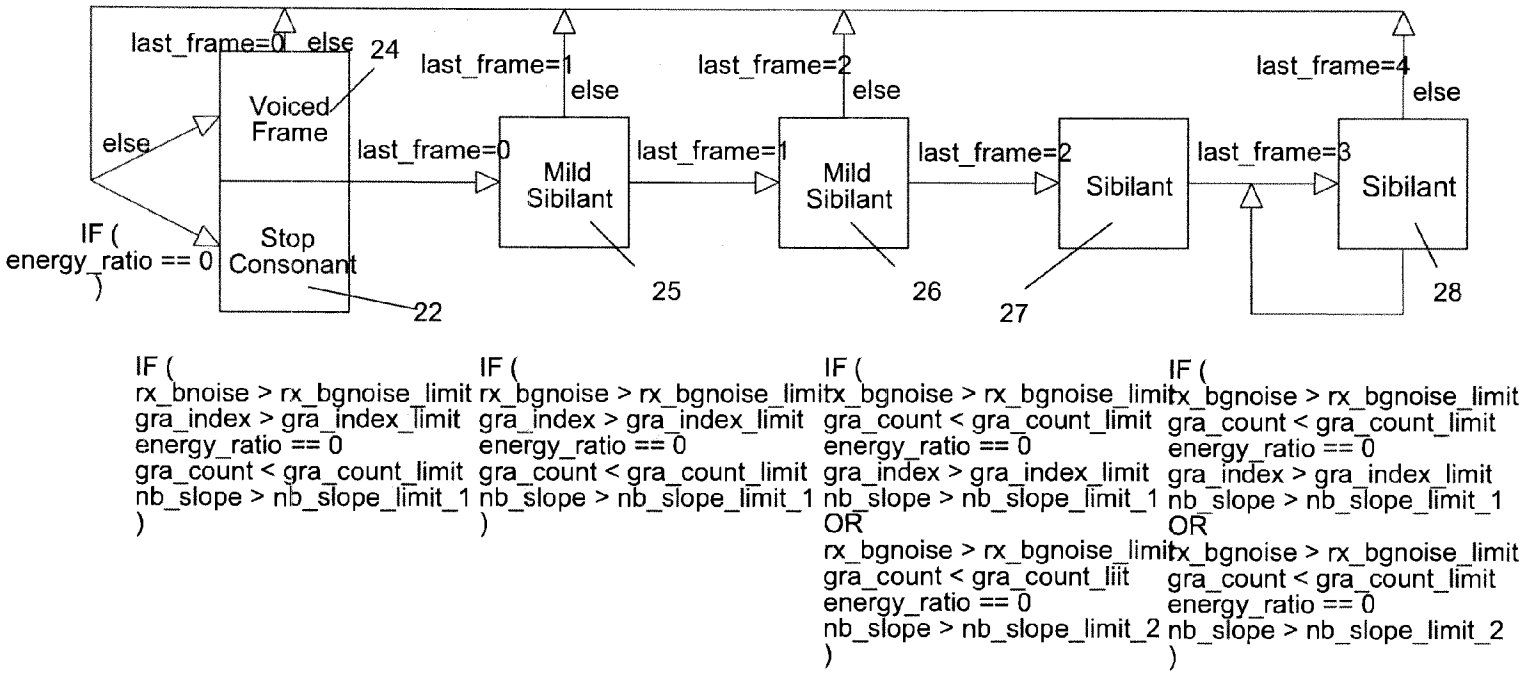
FIG. 2 is a diagram depicting operations in a frame classification procedure in accordance with an exemplary embodiment

FIG. 2 depicts operations in an exemplary frame classification procedure, showing which features are used in identifying different groups of phonemes. In an exemplary embodiment, the exemplary frame classification algorithm that classifies frames into different phoneme groups includes seven features to aid in classification accuracy and therefore in increased perceived audio quality. These seven features relate to better detection of sibilants and especially a better exclusion of stop-consonants from sibilant frames.

A frame classification procedure performs a classification decision based on this feature vector. In an exemplary embodiment, there are predefined threshold values for each feature and the decision is made by testing which condition is satisfied. The seven features can include (1) gradient index, (2) rx-background noise level estimate, (3) rx-SNR estimate, (4) general level of gradient indices, (4) the slope of the narrowband spectrum ($s_{nb}$), (5) the ratio of the energies of consecutive frames, (6) the information about how the previous frame was processed, and (7) the noise mode the algorithm operates in.

The gradient index is a measure of the sum of the magnitudes of the gradient of the speech signal at each change of direction. It is used in sibilant detection because the waveforms of sibilants change the direction more often and abruptly than periodic voiced sound waveforms. By way of example, for a sibilant frame, the value of the gradient index should be bigger than a threshold.

The gradient index can be defined as:

$$x_{gi} = \frac{1}{10} \frac{\sum_{\kappa=1}^{N_\kappa - 1} \Psi(\kappa) |s_{nb}(\kappa) - s_{nb}(\kappa - 1)|}{\sqrt{\sum_{\kappa=0}^{N_\kappa - 1} (s_{nb}(\kappa))^2}},$$

where $\Psi(K)=1/2|\psi(\kappa)-\psi(\kappa-1)|$ and $\psi(\kappa)$ is the sign function of the $\{s_{nb}(\kappa)-s_{nb}(\kappa-1)$ The rx-background noise level estimate can be based on a method called minimum statistics. Minimum statistics involves filtering the energy of the signal and searching for the minimum of it in short sub-frames. The background noise level estimate for each frame is selected as the minimum value of the minima of four preceding sub-frames. This estimation method provides that, even if someone is speaking, there are still some short pauses between words and syllables that contain only background noise. So by searching the minimum values of the energy of the signal, those instants of pauses can be found. Signals with high background noise level are processed as voiced sounds because amplification of the high band would affect the noise as well by making it sound annoying.

The Rx-SNR estimate can be calculated from average frame energy and background noise level estimate:

$$rx - SNR = \frac{rx \text{ average frame energy} - rx \text{ background noise level estimate}}{rx \text{ background noise level estimate}}$$

A feature that presents the general level of gradient indices is needed to prevent incorrect sibilant detections during silent periods. If the overall level of the gradient indices is high, e.g., more than 75% or the previous 20 frames have a gradient index larger than 0.6, it is considered that the frame contains only high pass characteristic background noise and no sibilant detections are made. The motivation behind this feature is that speech does not contain such fricatives very often.

The slope of the narrowband amplitude spectrum is positive during sibilants, whereas it is negative for voiced sounds. The feature, narrowband slope, is defined here as a difference in amplitude spectrum at frequencies 0.3 and 3.0 kHz.

The energy ratio is defined as the energy of the current frame divided by the energy of the previous frame. A sibilant detection requires that the current frame and two previous frames do not have too large of an energy ratio. On the other hand in the case of a plosive, the energy ratio is large because a plosive usually consists of a silence phase followed by a burst and an aspiration.

The parameter called last_frame contains information on how the previous frame was processed. This is needed because the first and second frames that are considered to be sibilant frames are processed differently than the rest of the frames. The transition from a voiced sound to a sibilant should be smooth. On the other hand, it is not for certain that the first two detected frames really are sibilants, so it can be important to process them carefully in order to avoid audible artifacts. The duration of a fricative is usually longer than the duration of other consonants. To be even more precise, the duration of other fricatives is often less than that of sibilants.

The parameter noise_mode contains information regarding in which noise mode the algorithm operates. Preferably, there are two noise modes, stationary and babble noise modes, as described within reference to FIG. 1.

The amount of the maximum attenuation of the modification function of voiced frames should generally be limited to only 2 dB range between adjacent frames. This condition guarantees smooth changes in the high band and thus reduces audible artifacts. The changing rate of the sibilant high band is also controlled. The first frame that is considered as a sibilant has a 15 dB extra attenuation and the second frame has a 10 dB extra attenuation. These extra attenuations guarantee a smooth transition from a voiced phoneme to sibilant.

Referring specifically to FIG. 2, an example process of a frame classification procedure according to one embodiment of the invention is depicted using if then statements and blocks for determinations based on the if-then determinations. If the energy ratio is zero, the speech signal is determined to be a stop consonant (block 22). Otherwise, the speech signal is a voiced frame (block 24). Once the energy ratio check has been made, a check of noise and the gradient index can be made against pre-set limits. For example, if rx_bgnoise is greater than a pre-determined limit, the gradient index is greater than a predetermined limit, the energy ratio is zero, the gradient count is less than a pre-determined limit, and nb_slope is greater than a pre-determined limit, the speech signal is considered a mild sibilant (block 25) and the last_frame parameter is set to zero. Otherwise, last_frame is set to one and the energy ratio is checked again.

Other if-then statements can be used to determine if the speech signal is considered a mild sibilant (block 26), a sibilant (block 27), or a sibilant (block 28) and the last_frame parameter is changed to reflect how the previous frame was processed.

As mentioned previously, noise can be divided into stationary noise and babble noise. Babble noise detection is based on three features: a gradient index based feature, an energy information based feature and a background noise level estimate. The energy information, $E_i$, can be defined as $$E_i = \frac{E[s''_{nb}(n)]}{E[s_{nb}(n)]},$$

where s(n) is the time domain signal, $E[s''_{nb}]$ is the energy of the second derivative of the signal and $E[s_{nb}]$ is the energy of the signal. For babble noise detection, the essential information is not the exact value of $E_i$, but how often the value of it is considerably high. Accordingly, the actual feature used in babble noise detection is not $E_i$ but how often it exceeds a certain threshold. In addition, because the longer-term trend is of interest, the information whether the value of $E_i$ is large or not is filtered. This is implemented so that if the value of energy information is greater than a threshold value, then the input to the IIR filter is one, otherwise it is zero. The IIR filter can be expressed as:

$$H(z) = \frac{1-a}{1-az^{-1}},$$

where a is the attack or release constant depending on the direction of change of the energy information.

The energy information can also have high values when the current speech sound has high-pass characteristics, such as for example /s/. In order to exclude these cases from the IIR filter input, the IIR-filtered energy information feature is updated only when the frame is not considered as a possible sibilant (i.e., the gradient index is smaller than a predefined threshold).

Gradient index is another feature used in babble noise detection. In babble noise detection, the gradient index can be IIR filtered with the same kind of filter as was used for energy information feature. The attack and release constants can be the same as well. The background noise estimation can be based on a method called minimum statistics, described above.

If all three features, (IIR-filtered energy information, IIR-filtered gradient index and background noise level estimate) exceed certain thresholds, then the frame is considered to contain babble noise. In at least one embodiment, in order to make the babble noise detection algorithm more robust, fifteen consecutive stationary frames are used to make the final decision that the algorithm operates in stationary noise mode. The transition from stationary noise mode to babble noise mode on the other hand requires only one frame.

For noise dependency, three parameters can be used. These parameters include the rx-noise mode decision, the rx-signal-to-noise ratio (rx-SNR) and the tx-signal-to-noise ratio (tx-SNR). The estimates of the background noise levels can be calculated using minimum statistics method. SNRs can be estimated from background noise level estimates and the average energy of the frame signal:

$$rx-SNR = \frac{rx \text{ average frame energy} - rx \text{ background noise level estimate}}{rx \text{ background noise level estimate}}$$

$$tx-SNR = \frac{rx \text{ average frame energy} - rx \text{ background noise level estimate}}{tx \text{ background noise level estimate}}$$

To avoid sudden jumps in SNR estimates, they can be IIR filtered with filters similar to those used in babble noise detection but having different attack and release constants.

For a voiced frame, a new parameter voiced_const can be defined. The parameter can include an extra constant gain in decibels for a voiced frame and thus determines the amount that the mirror image of the narrowband signal is modified. A larger negative value indicates greater attenuation and a more conservative artificial bandwidth expansion (ABE) signal. The value of the parameter voiced_const can be dependent on the rx-SNR and tx-SNR. Firstly, the value of voiced_const can be calculated according to the graph depicted in FIG. 3 and after that the effect of tx-SNR, tx_factor (FIG. 4) can be added to it. Parameter tx_factor gets positive values when tx noise is present and therefore reduces the amount of attenuation and makes the algorithm more aggressive.

To provide means for easy tuning of the algorithm, the calculation of voiced_const and, thus, the whole performance of the algorithm can be controlled with three other new parameters: abe_control, rx_control and tx_control. The effect that each of them has is described below.

Figure 3:
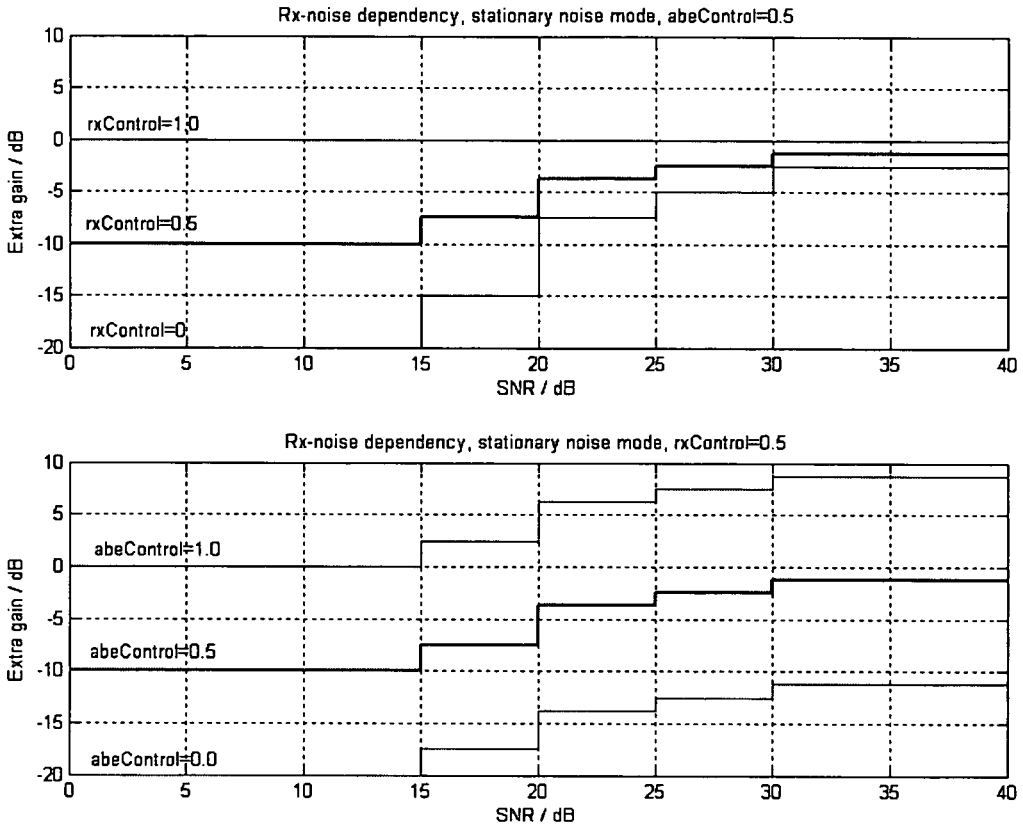
FIG. 3 is a graph depicting the influence of the rx-SNR estimate on the voiced coefficient that controls the processing of voiced sounds.

The parameter abe_control changes the overall level of the voiced const-curve and thus the overall conservativeness/aggressiveness of the algorithm. A maximum value (1) indicates very aggressive performance. A minimum value (0) on the other hand indicates the most conservative performance. The value range is [0,1] and the default value is 0.5 in both noise modes, as shown in FIG. 3.

The parameter rx_control changes the slope of the voiced_const-curve. A maximum value (1) indicates that the Rx-noise level does not affect the algorithm. A minimum value (0) on the other hand indicates the stongest dependency. The value range is [0,1], and the default value is 0.5 in both noise modes, as shown in FIG. 3.

Figure 4:
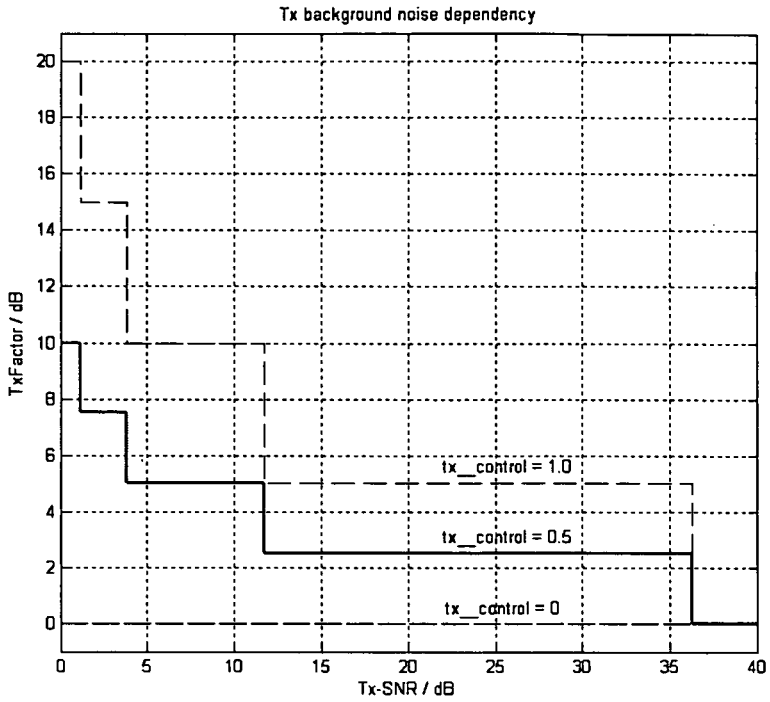
FIG. 4 is a graph depicting the influence of the tx-SNR estimate on the voice coefficient after the influence of rx-SNR has been taken into account.

The parameter tx_control changes the size of the steps of the tx-factor. A maximum value (1) indicates the stongest dependency. A minimum value (0) on the other hand indicates that the Tx-noise level does not affect the algorithm. The value range is [0,1], and the default value is 0.5 in stationary noise mode and 0.4 in babble noise mode, as shown in FIG. 4.

The processing of sibilants can also be dependent on the noise mode and SNR estimates. In babble noise mode, all the frames are processed as voiced frames, so no sibilant detections are performed because during babble noise the detection might generate false sibilant detections, because the background noise contains sibilant-like frames.

Figure 5:
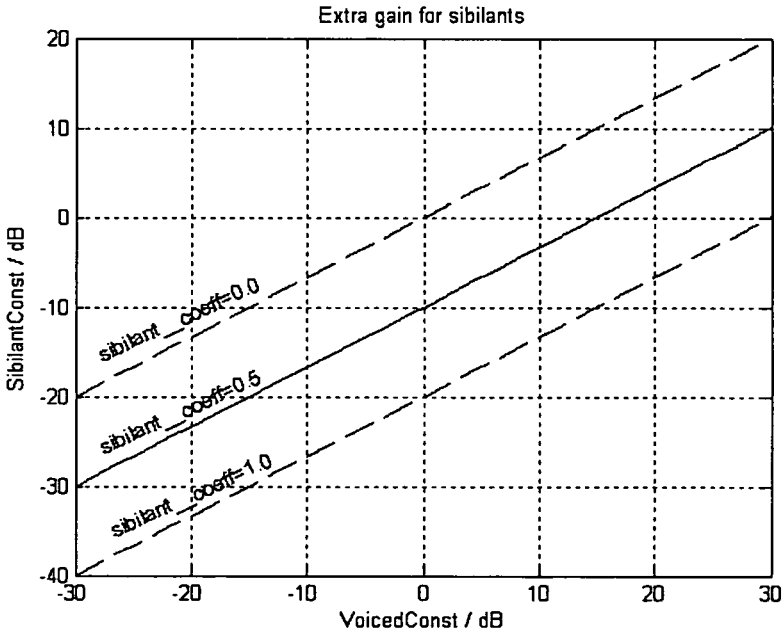
FIG. 5 is a graph depicting the definition of constant attenuation for sibilant frames after the voiced coefficient has been defined.

In stationary noise mode, signals with high background noise level can also be processed as voided sounds because amplification of the high band affects the noise as well by making it sound annoying. In the case of signals with low-level stationary noise, on the other hand, sibilants can be detected and the modification function for sibilants is controlled by a parameter, const_att. This parameter is an extra constant gain for sibilants so that if voiced frames are attenuated strongly, sibilants also have a larger extra constant attenuation. In other words, the value of const_att is dependent on the value of voiced_const, like as FIG. 5 illustrates.

To provide means for easy tuning of the algorithm, there is also a tunable parameter for sibilant frames, which controls the overall processing of sibilants. The sibilant_const parameter changes the overall level of the constant attenuation-curve. A maximum value (1) indicates very aggressive sibilants. A minimum value (0) on the other hand indicates the most conservative performance. The value range is [0,1] and the default value is 0.5, as shown in FIG. 5.

Figure 6:
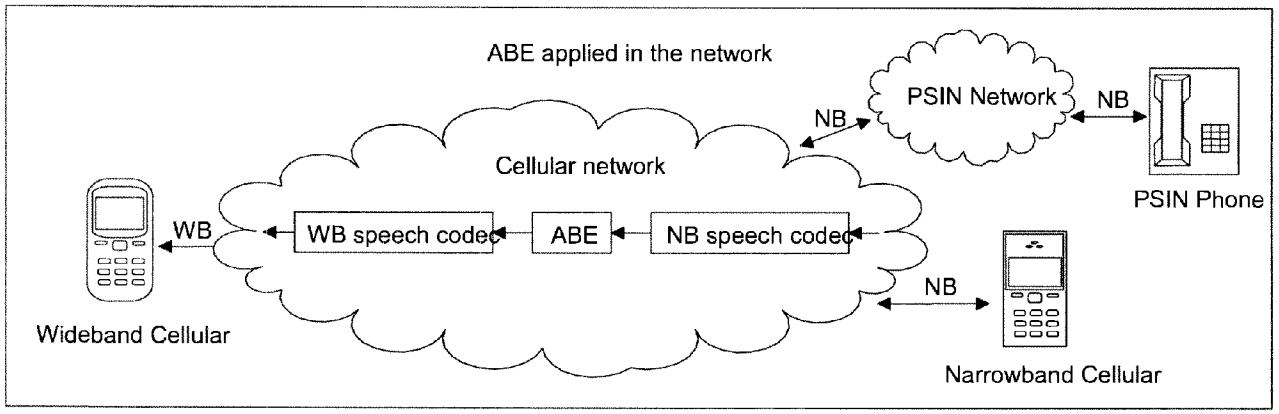
FIG. 6 is a diagram depicting the artificial bandwidth expansion applied in the network in accordance with an exemplary embodiment.
Figure 7:
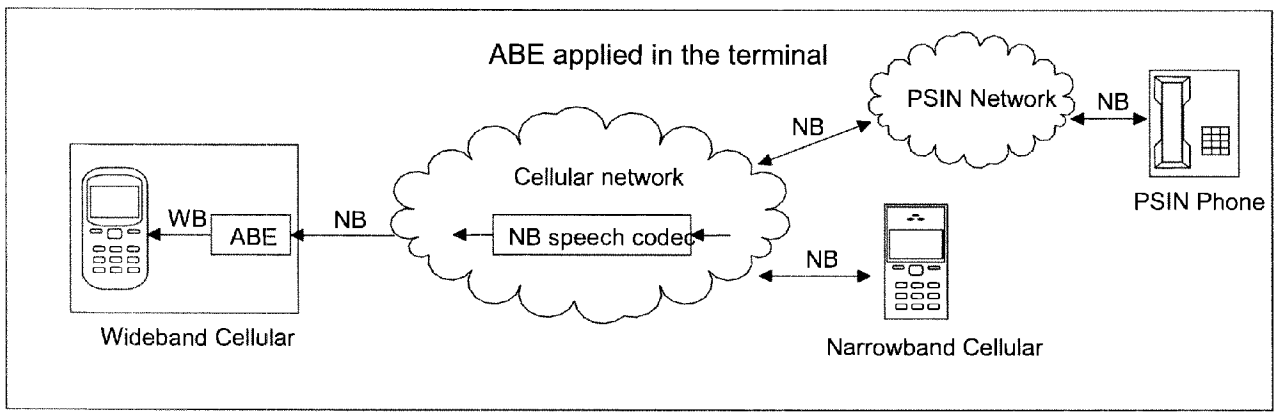
FIG. 7 is a diagram depicting the artificial bandwidth expansion applied at a wideband terminal in accordance with an exemplary embodiment.

FIG. 6 illustrates how the artificial bandwidth expansion (ABE) can be applied in a network. As applied in the network, the ABE can be implemented in networks that used both narrowband and wideband codecs. FIG. 7 illustrates how the artificial bandwidth expansion (ABE) can be applied in a terminal. As applied in the terminal, the ABE is located at the terminal and receives narrowband communications from the network. The ABE expands the communication to a wideband for the terminal. The ABE algorithm can be implemented with a digital signal processor (DSP) in the terminal.

The algorithm described reduces the number of artifacts caused by misclassification of frames. Further, rx- and tx-noise dependency makes it possible to tune the algorithm differently in different noise situations so that the audio quality and intelligibility are maximized in every situation. Other advantages of the ABE described include that no additional transmitted information is needed in order to improve the naturalness of the speech quality. No storage of a codebook is required. Further, the ABE can be implemented in real time with a reasonable computational cost. The adjustment of the aliased frequency components is computed using a robust frequency domain method. This reduces the risk of quality deterioration due to insufficient attenuation of the upper frequency components.

This detailed description outlines exemplary embodiments of a method, device, and system for a enhanced artificial bandwidth expansion for signal quality improvement. In the foregoing description, for purposes of explanation, numerous specific details are set forth in order to provide a thorough understanding of the present invention. It is evident, however, to one skilled in the art that the exemplary embodiments may be practiced without these specific details. In other instances, structures and devices are shown in block diagram form in order to facilitate description of the exemplary embodiments.

While the exemplary embodiments illustrated in the Figures and described above are presently preferred, it should be understood that these embodiments are offered by way of example only. Other embodiments may include, for example, different techniques for performing the same operations. The invention is not limited to a particular embodiment, but extends to various modifications, combinations, and permutations that nevertheless fall within the scope and spirit of the appended claims.

What is claimed is:

1. A method for expanding narrowband speech signals to wideband speech signals, the method comprising:

determining signal type information from a signal;

obtaining characteristics for forming an upper band signal using the determined signal type information;

detecting babble noise in the signal based on a gradient index, enemy information, and a noise level estimate;

determining signal noise information, wherein the signal noise information is determined based on a far-end signal-to-noise ratio and a near-end signal-to-noise ratio;

using the determined signal noise information to modify the obtained characteristics for forming the upper band signal; and forming the upper band signal using the modified characteristics.

2. The method claim 1, wherein the determining of the signal noise information comprises estimating the far-end signal-to-noise ratio using information on energy of a portion of the signal and a background noise level estimate.

3. The method of claim 2, wherein the determining of the signal noise information comprises estimating the near-end signal-to-noise ratio.

4. The method of claim 1, further comprising classifying the signal into different phoneme groups based on the gradient index and the far-end signal-to-noise ratio.

5. A communication device configured to receive wideband signals, the device comprising:

an interface that communicates with a wireless network; and programmed instructions stored in a memory and configured to expand received narrowband signals to wideband signals by adjusting an artificial bandwidth expansion algorithm based on noise conditions, wherein the noise conditions comprise a far-end signal-to-noise ratio and a near-end signal-to-noise ratio; and detect babble noise based on a gradient index, energy information, and a noise level estimate.

6. The device of claim 5, wherein the programmed instructions are implemented with a digital signal processor (DSP).

7. A device in a communication network that expands narrowband speech signals into wideband speech signals, the device comprising:

a narrowband codec that receives narrowband speech signals in a network;

a wideband codec that communicates wideband speech signals to wideband terminals in communication with the network; and programmed instructions that expand the narrowband speech signals to wideband speech signals by adjusting an artificial bandwidth expansion algorithm based on noise conditions, wherein the noise conditions comprise a far-end signal-to-noise ratio and a near-end signal-to-noise ratio and detect babble noise based on a gradient index, energy information, and a noise level estimate.

8. A system for expanding narrowband speech signals to wideband speech signals, the system comprising:

means for determining signal type information from a signal;

means for obtaining characteristics for forming an upper band signal using the determined signal type information;

means for detecting babble noise based on a gradient index, energy information, and a noise level estimate means for determining signal noise information, wherein the signal noise information is determined based on a far-end signal-to-noise ratio and a near-end signal-to-noise ratio;

means for using the determined signal noise information to modify the obtained characteristics for forming the upper band signal; and means for forming the upper band signal using the modified characteristics.

9. A computer program product, embodied in a computer-readable medium, that expands narrowband speech signals to wideband speech signals, the computer program product comprising:

computer code to:

determine signal type information from a signal;

obtain characteristics for forming an upper band signal using the determined signal type information;

detect babble noise based on a gradient index, energy information, and a noise level estimate determine signal noise information, wherein the signal noise information is determined based on a far-end signal-to-noise ratio and a near-end signal-to-noise ratio;

use the determined signal noise information to modify the obtained characteristics for forming the upper band signal; and form the upper band signal using the modified characteristics.

10. The computer program product of claim 9, wherein the computer code further expands the signal from a narrowband signal to a wideband signal based on signal gradient index, signal far-end signal-to-noise ratio, and signal near-end signal-to-noise ratio.

11. The computer program product of claim 9, wherein the computer code further estimates a near-end signal-to-noise ratio.

* * * * *

UNITED STATES PATENT AND TRADEMARK OFFICE

CERTIFICATE OF CORRECTION

PATENT NO. : 8,712,768 B2
APPLICATION NO. : 10/853820
DATED : April 29, 2014
INVENTOR(S) : Laaksonen et al.

It is certified that error appears in the above-identified patent and that said Letters Patent is hereby corrected as shown below:

In the claims:

Column 8, Claim 1
Line 20, "enemy in formation" should read --energy information--.

Signed and Sealed this
Twenty-ninth Day of July, 2014

Michelle K. Lee

Michelle K. Lee
*Deputy Director of the United States Patent and Trademark Office*